US006161920A

United States Patent [19]

Santhanam et al.

[11] Patent Number: 6,161,920

[45] Date of Patent: Dec. 19, 2000

[54] TECHNIQUES FOR ADAPTING A SMALL FORM FACTOR INK-JET CARTRIDGE FOR USE IN A CARRIAGE SIZED FOR A LARGE FORM FACTOR CARTRIDGE

[75] Inventors: Ram Santhanam, San Diego; Erich E. Coiner, Poway, both of Calif.

[73] Assignee: Hewlett-Packard Company, Palo Alto, Calif.

[21] Appl. No.: 09/477,843

[22] Filed: Jan. 5, 2000

[51] Int. Cl.[7] ..... B41J 2/175

[52] U.S. Cl. ..... 347/50

[58] Field of Search ..... 347/86, 87, 49, 347/50

[56] References Cited

U.S. PATENT DOCUMENTS

| | | | |
|---|---|---|---|
| 4,755,836 | 7/1988 | Ta et al. | 347/49 |
| 4,771,295 | 9/1988 | Baker et al. | 347/85 |
| 4,872,026 | 10/1989 | Rasmussen et al. | 347/56 |
| 4,907,018 | 3/1990 | Pinkerpell et al. | 347/87 |
| 5,049,904 | 9/1991 | Nakamura et al. | 347/19 |
| 5,138,344 | 8/1992 | Ujita | 347/86 |
| 5,204,691 | 4/1993 | Sanford | 347/226 |
| 5,392,063 | 2/1995 | Rhoads | 347/49 |
| 5,393,063 | 2/1995 | Rhoads | 347/49 |
| 5,552,816 | 9/1996 | Oda et al. | 347/86 |
| 5,917,524 | 6/1999 | Kimura et al. | 347/86 |

*Primary Examiner*—N. Le
*Assistant Examiner*—Anh T. N. Vo

[57] ABSTRACT

An ink delivery system which includes a short form factor ink jet pen having a supply of ink for depositing on an ink receiving medium. An adapter is mounted to the short form factor pen to permit it to be removably mounted within a pen receptacle or stall dimensioned to receive a tall form factor pen. The ink jet cartridge includes a housing, a printhead mounted on the housing, datum surfaces on the housing for registering a position of the housing in a fixed, repeatable position in a first carriage structure, and a cartridge set of electrical contacts mounted to the cartridge housing and electrically coupled to the printhead. The cartridge set of electrical contacts is positioned on the housing for electrical contact with a corresponding first carriage set of electrical contacts when the cartridge is mounted in the first carriage structure. The adapter structure is mounted to the cartridge housing to provide an assembly of the adapter structure and the cartridge, the assembly adapted for mounting in a second carriage structure configured to receive an inkjet cartridge of a different size in a fixed, repeatable position. The second carriage structure has a second carriage set of electrical contacts, and contact is made between the set of electrical contacts and the second carriage set of contacts when the cartridge is in the fixed, repeatable position in the second carriage structure.

21 Claims, 7 Drawing Sheets

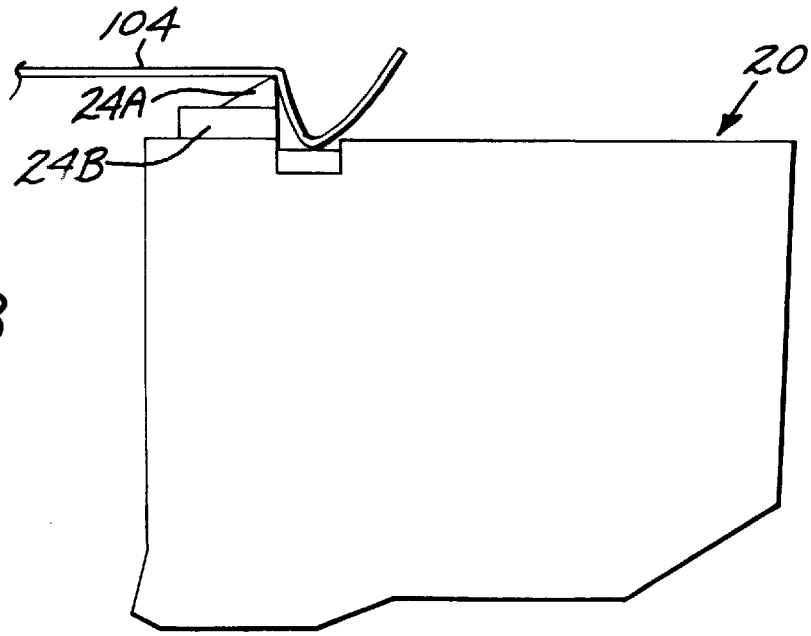
FIG. 3
FIG. 4
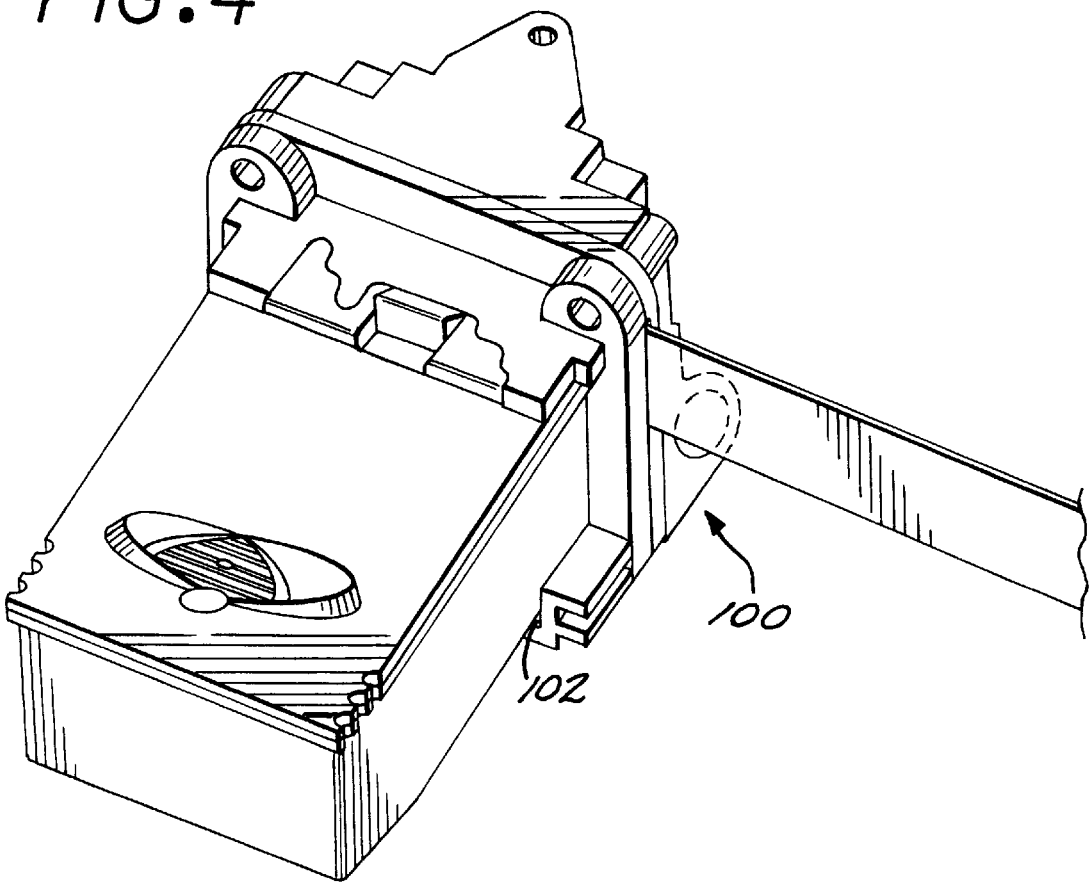

TECHNIQUES FOR ADAPTING A SMALL FORM FACTOR INK-JET CARTRIDGE FOR USE IN A CARRIAGE SIZED FOR A LARGE FORM FACTOR CARTRIDGE

CROSS-REFERENCE TO RELATED APPLICATIONS

This application is related to the following copending utility patent applications, each filed concurrently on Jan. 5, 2000: Ser. No. 09/477,645, by Ram Santhanam et al., entitled "Vent For An Ink-Jet Print Cartridge", Ser. No. 09/477,646, by Ram Santhanam et al., entitled "Ink-Jet Print Cartridge Having A Low Profile", Ser. No. 09/477,644, by Junji Yamamoto et al., entitled "Horizontally Loadable Carriage For An Ink-Jet Printer", Ser. No. 09/477,649, by Junji Yamamoto et al., entitled "Method And Apparatus For Horizontally Loading And Unloading An Ink-Jet Print Cartridge From A Carriage", Ser. No. 09/478,148, by Richard A. Becker et al., entitled "Techniques For Providing Ink-Jet Cartridges With A Universal Body Structure", Ser. No. 09/478,190, by James M. Osmus, entitled "Printer With A Two Roller, Two Motor Paper Delivery System", Ser. No. 09/477,860, by Keng Leong Ng, entitled "Low Height Inkjet Service Station", Ser. No. 09/477,648, by Matt Shepherd et al., entitled "New Method Of Propelling An Inkjet Printer Carriage", Ser. No. 29/116,564, by Ram Santhanam et al., entitled "Ink Jet Print Cartridge", and Ser. No. 09/477,940, by Ram Santhanam et al., entitled "Multiple Bit Matrix Configuration For Key-Latched Printheads", the entire contents of which applications are incorporated herein by reference.

TECHNICAL FIELD OF THE INVENTION

This invention relates to ink-jet pens and printers, and more particularly to techniques for adapting a small ink-jet pen for operation in a printer carriage constructed to receive an ink-jet pen of a larger size.

BACKGROUND OF THE INVENTION

Ink-jet printers are in widespread use today for printing functions in personal computers, graphics plotters, facsimile machines and other applications. Such printers typically include replaceable or semipermanent print cartridges which hold a supply of ink and carry the ink-jet printhead. The cartridge typically is secured into a printer carriage which supports one or a plurality of cartridges above the print medium, and traverses the medium in a direction transverse to the direction of medium travel through the printer. Electrical connections are made to the printhead by flexible wiring circuits attached to the outside of the cartridge. The carriage receptacle has a corresponding electrical circuit with exposed contact pads which contact cartridge interconnect pads when the cartridge is mounted in the carriage. Each printhead includes a number of tiny nozzles defined in a substrate and nozzle plate structure which are selectively fired by electrical signals applied to the interconnect pads to eject droplets of ink in a controlled fashion onto the print medium. The cartridge may be connectable to auxiliary supplies of ink for replenishing the internal supply held in the cartridge. In order to achieve accurate printing quality, each removable cartridge includes datum surfaces which engage against corresponding carriage surfaces to precisely locate the cartridge when inserted into the carriage. In this manner, when a cartridge ink supply is exhausted, the cartridge may be replaced with a fresh cartridge, and the printhead of the new cartridge will be precisely located relative to the carriage. The printer carriage receptacle and the cartridge are therefore designed together, so that the cartridge fits accurately within the carriage receptacle, the respective circuit pads and datum surfaces match up, and the cartridge can be removed and replaced with a fresh cartridge as needed.

Inkjet cartridges can be of varying shapes and sizes. Heretofore, a cartridge of one size could not be used in a printer carriage designed to receive a cartridge of a different size, since the datums and the electrical contacts on the cartridge and the carriage would not match up.

It would therefore be an advantage to provide a technique to allow a cartridge of one size or configuration to be used in a printer with a carriage receptacle designed for use with a cartridge of a different size or configuration.

SUMMARY OF THE INVENTION

In accordance with one aspect of the invention, an ink delivery system is disclosed, which includes a short form factor ink jet pen having a supply of ink for depositing on an ink receiving medium during printing operations. An adapter is mounted to the short form factor pen to permit it to be removably mounted within a carriage receptacle or stall dimensioned to receive a tall form factor cartridge.

According to another aspect of the invention, an adapter kit for inkjet cartridges is described. The kit includes an inkjet cartridge including a housing, a printhead mounted on the housing, a plurality of datum surfaces on the housing for registering a position of the housing in a fixed, repeatable position in a first carriage structure, and a cartridge set of electrical contacts mounted to the cartridge housing and electrically coupled to the printhead. The cartridge set of electrical contacts is positioned on the housing for electrical contact with a corresponding first carriage set of electrical contacts when the cartridge is mounted in the first carriage structure. An adapter structure is provided for attachment to the cartridge housing to provide an assembly of the adapter structure and the cartridge, the assembly adapted for mounting in a second carriage structure configured to receive an inkjet cartridge of a different size in a fixed, repeatable position. The second carriage structure has a second carriage set of electrical contacts, and contact is made between the set of electrical contacts and the second carriage set of contacts when the cartridge is in the fixed, repeatable position in the second carriage structure.

In a first embodiment, the adapter is a unitary structure adapted for mounting onto the top of the cartridge. In another embodiment, the adapter has a pressure connector for affixing the adapter to the cartridge.

Methods for using a short form factor ink-jet cartridge with an adapter are also disclosed.

BRIEF DESCRIPTION OF THE DRAWING

These and other features and advantages of the present invention will become more apparent from the following detailed description of an exemplary embodiment thereof, as illustrated in the accompanying drawings, in which:

FIG. 3 is a simplified side view illustrating the latching of the cartridge of FIG. 1 in a carriage receptacle.

FIG. 4 is an isometric view of the cartridge of FIG. 1 mounted in a carriage receptacle.

DETAILED DESCRIPTION OF THE PREFERRED EMBODIMENT

A small form factor inkjet cartridge 20 is shown in FIGS. 1–4, and is characterized by a relatively small height dimension H1, in this exemplary embodiment on the order of 45 mm. This is compared to a typical height dimension of 72 mm for the HP 51629A (black ink), 51629G (black ink), 51649A (tri-color) and 51649G (tri-color) cartridges marketed by Hewlett-Packard Company. The width dimension W1 and depth dimension D1 are the same as for these already marketed cartridges; typical values for W1 and D1 are 30.9 mm and 48.3 mm, respectively. The small form factor cartridge 20 has utility for a variety of applications, including by way of example low profile printing devices and entertainment center printers.

Figure 1:
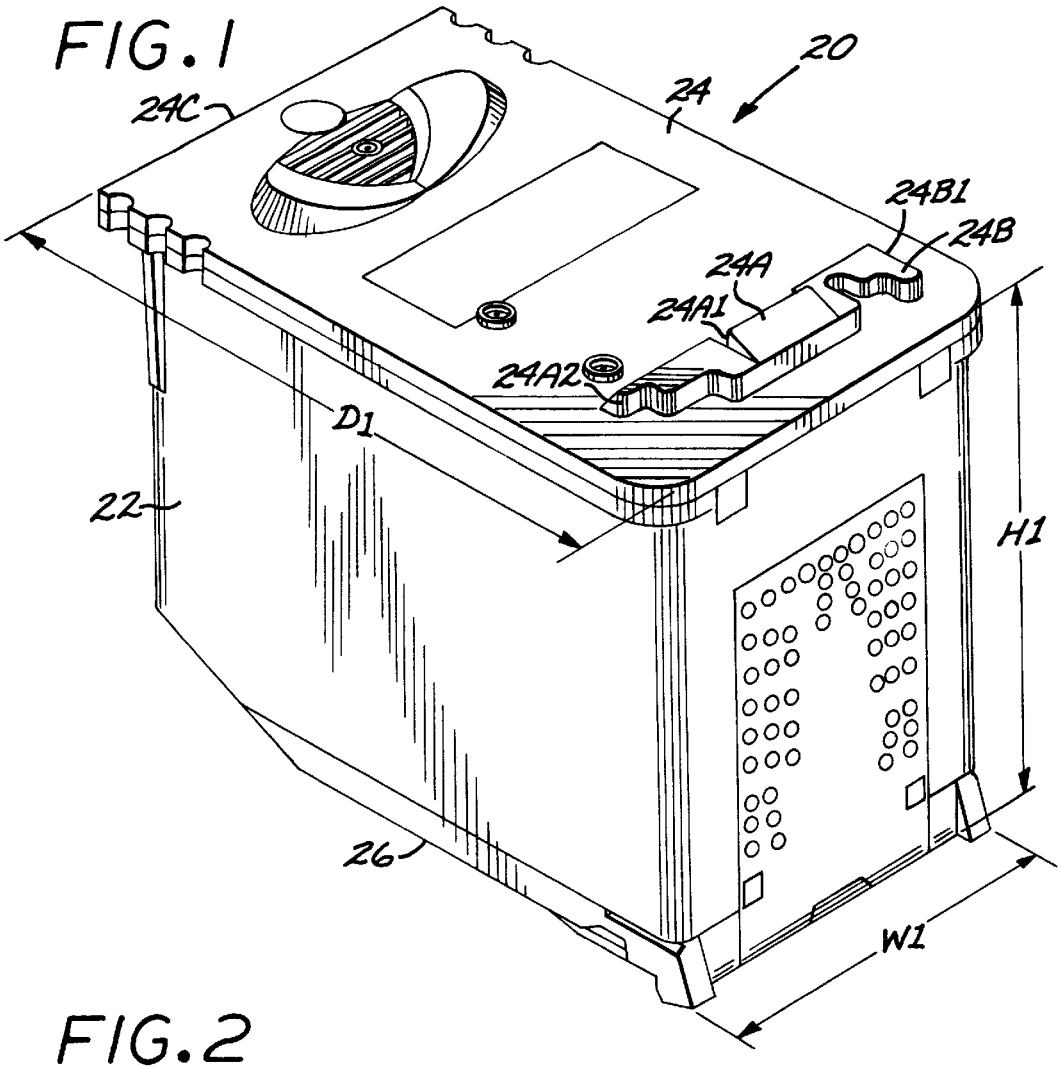
FIG. 1 is an isometric view of a small form factor inkjet cartridge with which the subject invention can be employed.
Figure 2:
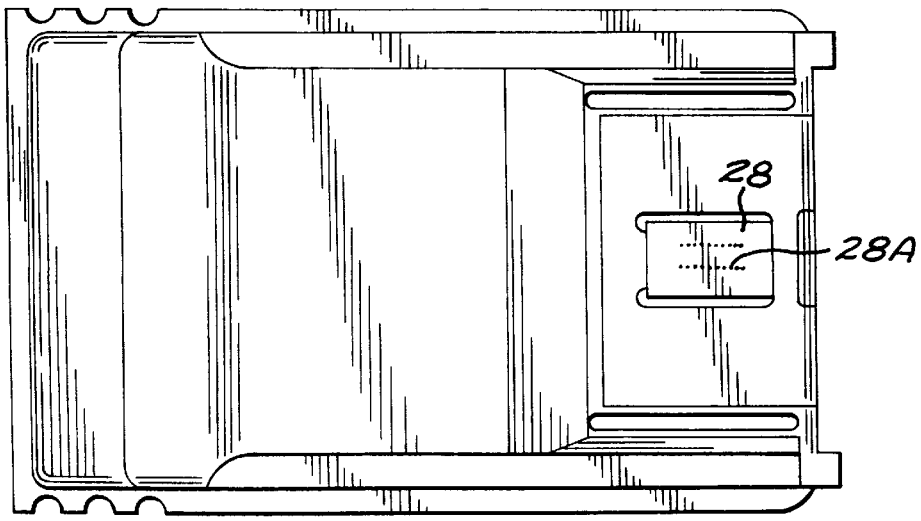
FIG. 2 is a bottom view of the cartridge of FIG. 1.
Figure 5:
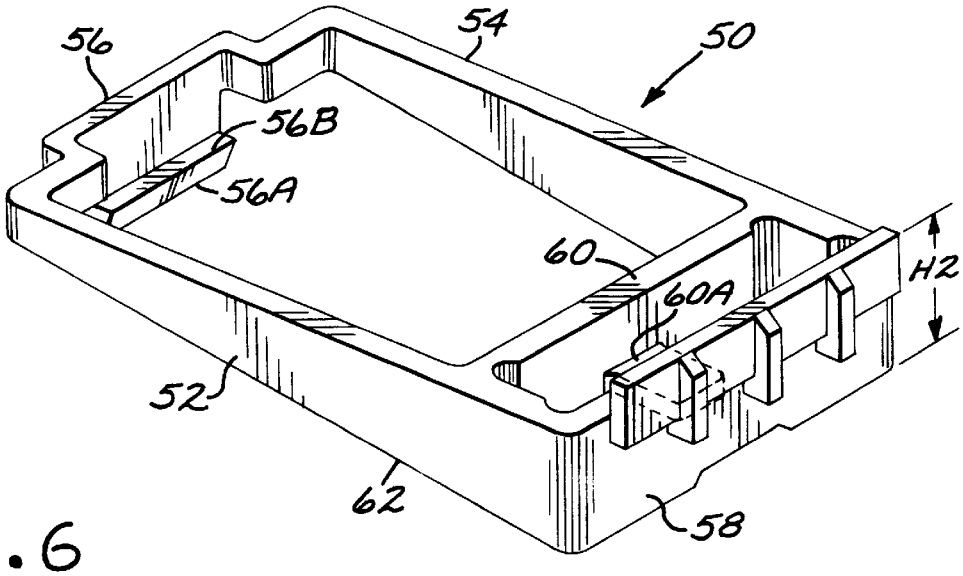
FIG. 5 is an isometric view of an adapter structure in accordance with the invention.
Figure 6:
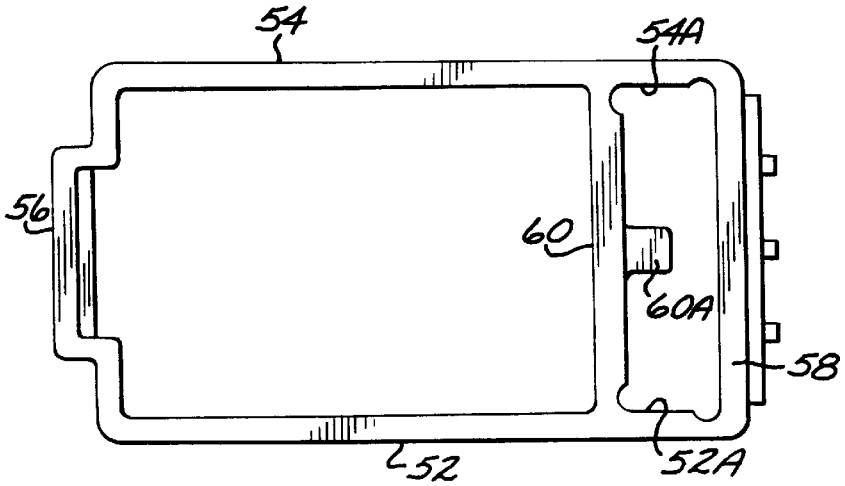
FIG. 6 is a top view of the adapter structure of FIG. 5.

The cartridge 20 includes a cartridge housing 22, typically fabricated of a plastic material, to which a top end cap or lid 24 is attached, e.g. by adhesive or ultrasonic bonding techniques. A bottom end cap or nose piece 26 is attached to the lower end of the housing, and supports a printhead 28 (FIG. 2). The housing 22 has formed therein at least one ink reservoir chamber, filled with a foam material in this example, for holding a supply of ink to supply the printhead during printing operations for delivering ink droplets onto a print medium during printing operations. The ink reservoir includes an ink outlet port in fluid communication with the chamber. The cartridge 20 is described more fully in the above referenced patent applications, and particularly in the application entitled "Techniques for Providing Ink-Jet Cartridges with a Universal Body Structure." The printhead is fabricated in this exemplary embodiment as part of a TAB flexible circuit attached to the housing, and the bottom end cap, and includes a plurality of ink ejection orifices generally indicated as 28A (FIG. 2) communicating with the supply of ink in the reservoir through a reservoir outlet port. The TAB circuit further includes a cartridge set of electrical contact pads, which are interconnected through the TAB circuit to corresponding nozzle firing resistors of the thermal inkjet printhead. When the cartridge is mounted in a carriage receptacle, the cartridge set of contacts is brought into contact with a corresponding set of carriage contacts, for supplying drive signals to the printhead. Other types of cartridge reservoirs, printheads, and circuits can alternatively be employed without departing from the invention.

The top cap or lid 24 of the cartridge body has formed as an integral part thereof a boss or beveled latch feature 24A, and a keying feature 24B. The latch feature 24A is adapted to provide a latching surface against which a carriage latch member engages as the cartridge is inserted into a carriage receptacle adapted to receive the cartridge. This is illustrated in FIG. 3, wherein a cantilevered latch spring 104 is shown in a latched position relative to the cartridge body. The keying feature 24B is adapted to match with corresponding receptacle keying features, when the cartridge is mounted in the carriage receptacle.

FIG. 4 illustrates the cartridge 20 mounted in a carriage 100, and particularly in a carriage receptacle 102 which is dimensioned particularly to receive the cartridge 20. The cartridge and the receptacle are particularly adapted for use as a front loading system, wherein the cartridge is inserted in a sideways-facing receptacle opening or guide chute. The guide chute can be formed as an injection molded part, with short sidewall structures on the bottom and left and right sides of the chute. A carriage latch feature 104 and a receptacle keying feature 106 are formed at the top side of the receptacle chute. Thus, the guide chute is formed on three sides by short walls which extend only along a short portion of the cartridge body. To load the cartridge 20 into the receptacle carriage receptacle, the bottom of the cartridge is first inserted into the guide chute at an angle, and then the back of the cartridge is pushed back to engage the latch spring over the latch feature of the cartridge.

In accordance with an aspect of the invention, an adapter structure is provided, which assembles to the cartridge 20 in order to adapt the small form factor cartridge 20 for use as an ink delivery system in a printer carriage sized for a large or tall form factor cartridge. One embodiment of an adapter structure 50 is illustrated in FIGS. 5–8. The adapter 50 is fabricated of a hard plastic material such as polycarbonate, and is a frame sized to mount in place on the top of the cartridge body. The adapter thus comprises side rail portions 52, 54, end rail portions 56 and 58 and transverse rib 60. The width of the adapter structure 50 is slightly smaller than the width of the top cap 24. The structure 50 has a bottom edge 60 which is generally planar, and contacts the outer periphery of the top surface of the cap 24 when the structure is assembled to the cartridge.

The end rail portion 56 is adapted to fit at the rear of the cartridge 20 when assembled to the position, and includes a downwardly extending tab portion 56B with a protruding latch rib 56A. The latch rib is fitted under the edge of the protruding rim 24C of the top cap 24 of the cartridge when the adapter is assembled to the cartridge. The end rail portion 58 and the rib structure 60 are positioned to straddle the latch feature 24B at the front end of the top cap. The rib structure 60 includes a protruding center tab 60A which is sized such that the tip of the tab is positioned against the adjacent vertical surface 24A1 of the latch feature. Moreover, the interior surfaces 52A, 54A of the respective side rails 52, 54 are spaced apart such that each contacts a respective side surface 24A2 and 24B1 of the top cap 24 when the adapter is assembled to the cartridge. Thus, the adapter 50 is registered in position relative to the cartridge by the tab structure 56B against the edge 24C, and the contact of the rib structure 60 and side rail surfaces against latch feature surfaces.

The adapter structure front end has a height dimension H2 which is selected with the height H1 of the cartridge 20 to provide an overall height of the assembly of the adapter 50 and the cartridge 20 to equal a height of a tall form factor cartridge. Moreover, the adapter 50 provides a datum surface at 72 which duplicates the location of a corresponding datum surface at 92 of a corresponding tall form factor cartridge 90 (FIG. 9).

Figure 8:
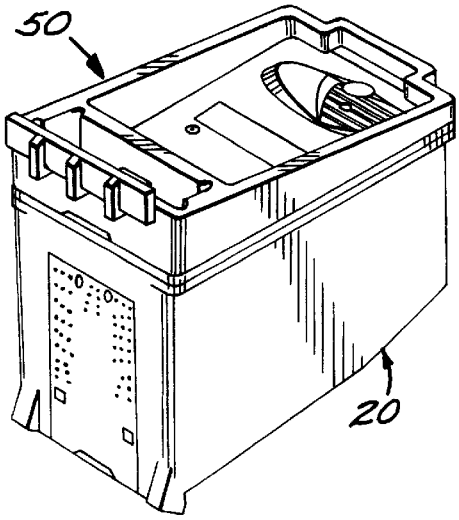
FIG. 8 is an isometric view of the assembly of FIG. 7.
Figure 7:
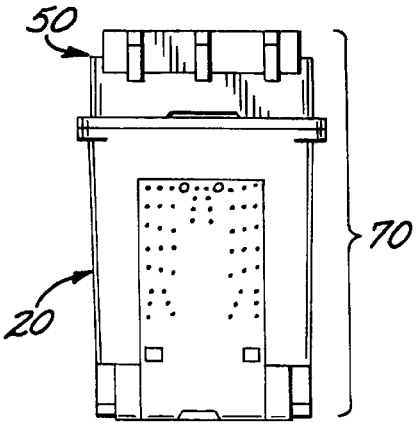
FIG. 7 is a front view of an assembly of the cartridge of FIG. 1 and the adapter structure of FIG. 5.

FIGS. 7 and 8 illustrate the cartridge 20 and adapter structure 50 in an assembled condition, forming an assembly or ink delivery system 70.

Figure 9:
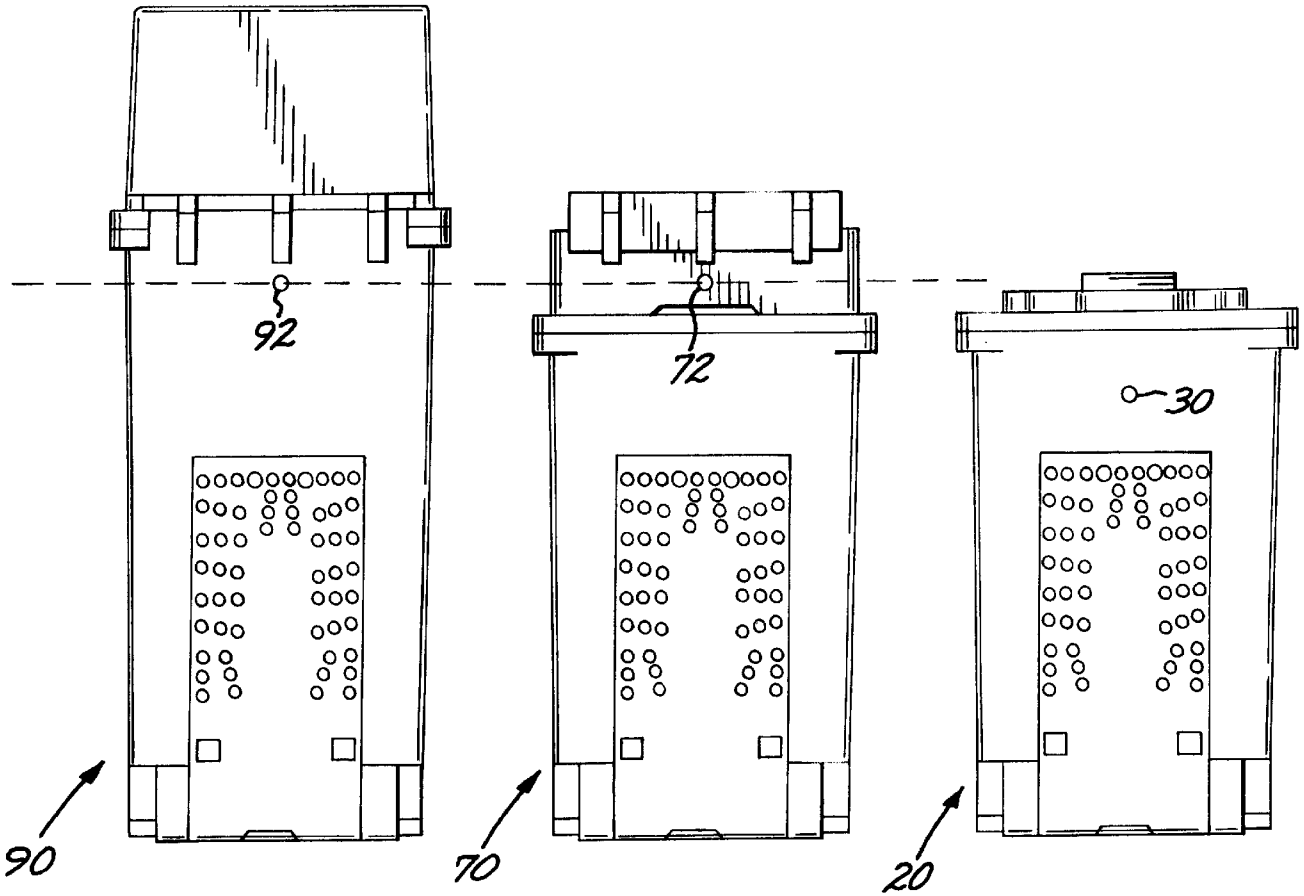
FIG. 9 is a front view illustrating a size comparison of the cartridge of FIG. 1, the assembly of FIG. 7 and a large form factor ink-jet cartridge.

FIG. 9 is a front view showing a height comparison of the small form factor cartridge 20, the assembly 70 of the cartridge 20 and the adapter structure 50, and a large form factor cartridge 90, say an HP 51649A cartridge. While the large form factor cartridge has an overall height much larger than the overall height of the assembly 70, the datum height of the cartridge 90 at 92 and the datum height of the assembly 70 at 72 are intended to be identical. The datum surfaces 72 and 92 will contact a corresponding carriage datum when the respective cartridges are mounted in a carriage sized for the large form factor cartridge 90. Moreover, the respective width and depth of the cartridge 20 are the same as the corresponding width and depth of the cartridge 90. Further, the printhead and the electrical contact pattern of the TAB circuit of the cartridge 90 and the printhead and the electrical contact pattern of the cartridge 20 are identical, so that either cartridge will be properly driven by similar signals.

Figure 10:
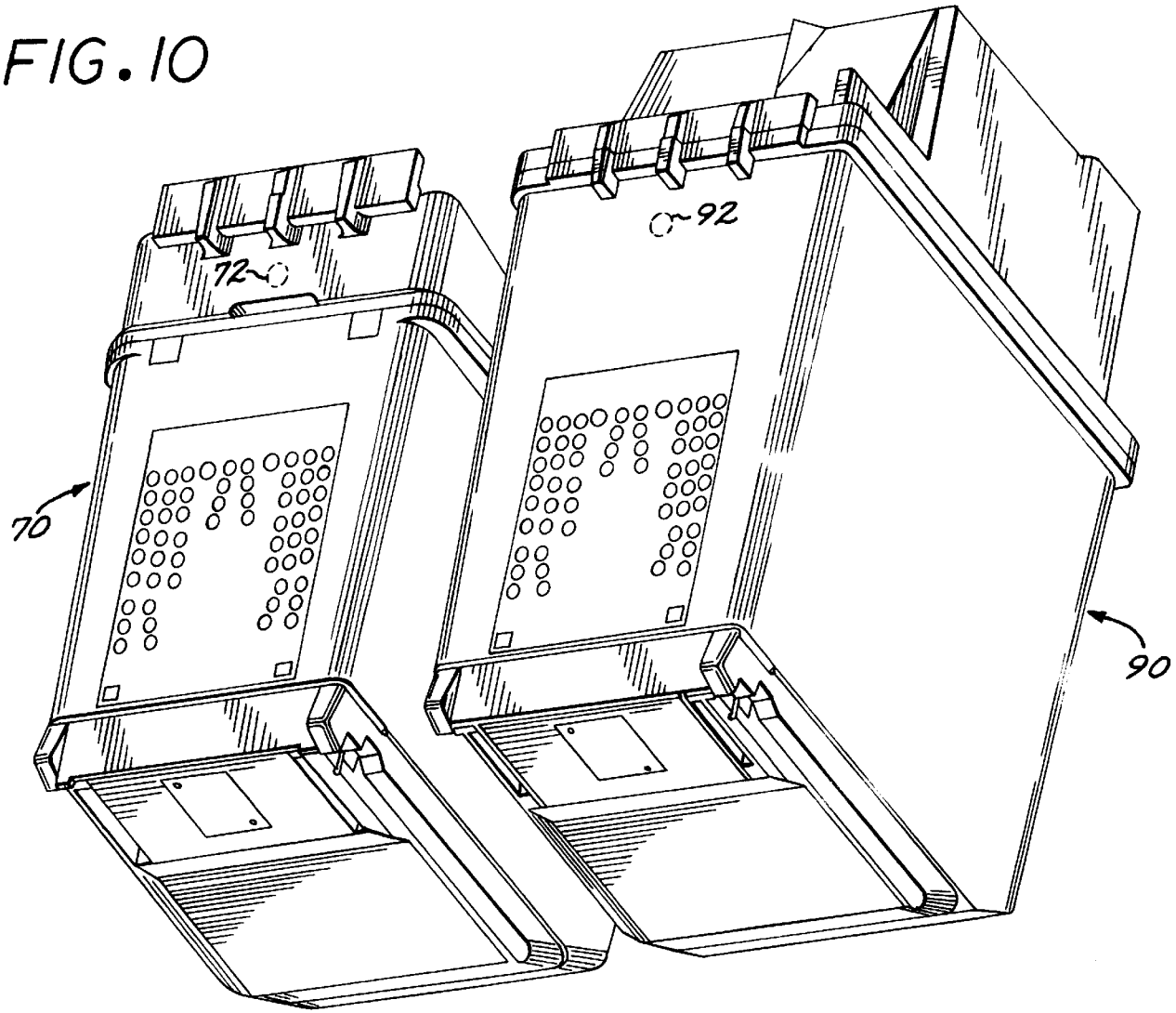
FIG. 10 is a bottom side isometric view of a small form factor cartridge assembly in accordance with the invention and a large form factor cartridge.

FIG. 10 illustrates both the small form factor cartridge assembly 70 and the large form factor cartridge 90 in an isometric bottom side view. This illustrates the identical nose piece structures for the two cartridges.

Figure 11:
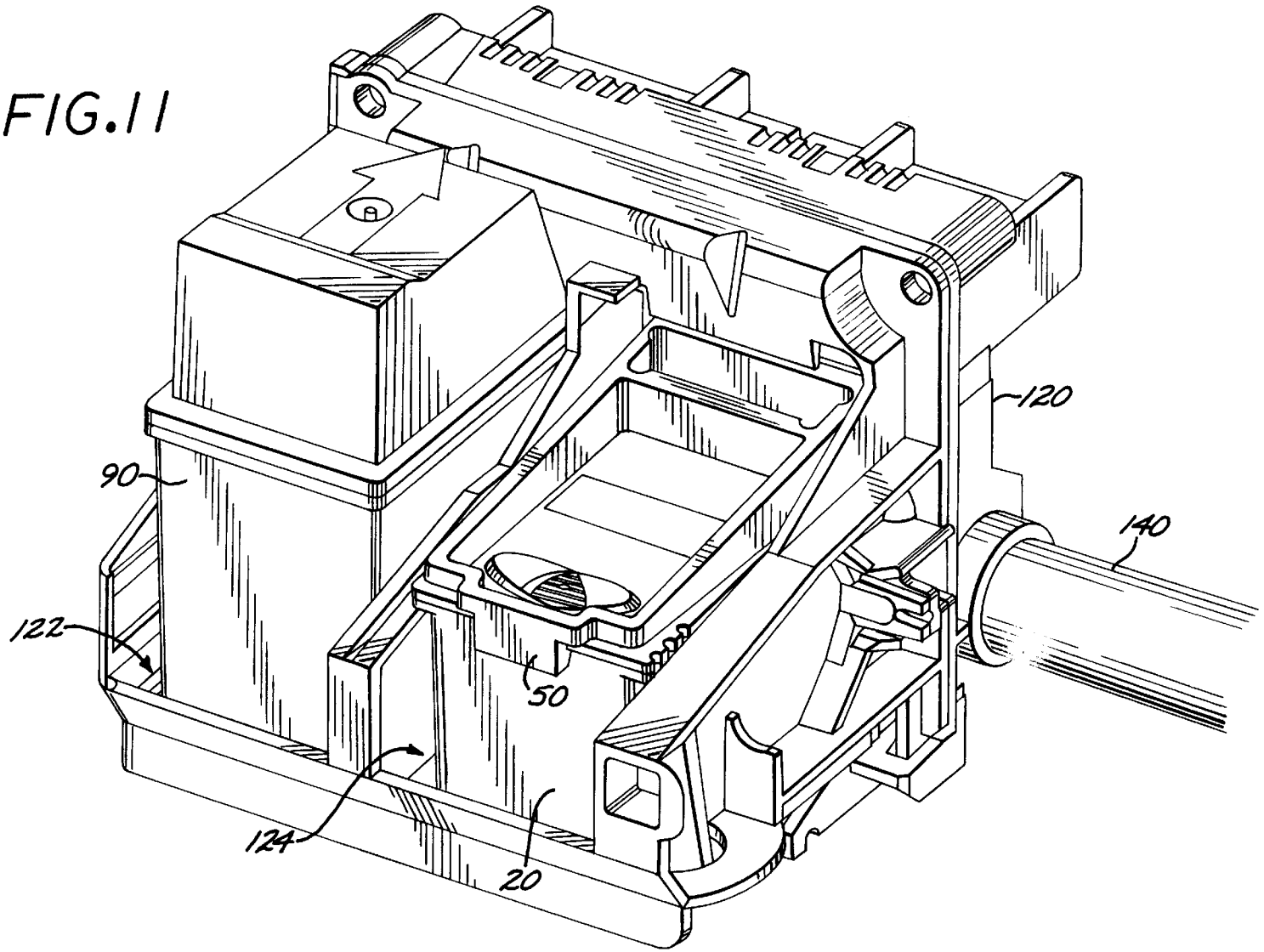
FIG. 11 is an isometric view of a carriage sized for mounting two large form factor cartridges, and having mounted therein one large form factor cartridge and one small form factor cartridge with an adapter in accordance with the invention.

FIG. 11 is an isometric view of a carriage 120 mounted on a slider rod 140 for translational movement along a carriage scan axis. The carriage 120 in this exemplary embodiment has two cartridge stalls 122 and 124 sized for mounting therein a corresponding large form factor cartridge 90, with corresponding carriage datum surfaces including a carriage datum surface for engaging against datum surface 92 of the cartridge 90, for precisely registering the position of the cartridge in the stall, and corresponding TAB circuits for electrically interconnecting with corresponding cartridge TAB circuits. In accordance with the invention, a small form factor cartridge 20 with an adapter structure 50 can be mounted in a stall of the carriage, and still be registered in position with datum surface 72 contacting a corresponding carriage datum surface, and provide the necessary electrical connection with the carriage TAB circuit. In the example of FIG. 11, stall 122 has mounted therein a large form factor cartridge 90, and stall has mounted therein a small form factor cartridge 20 with an adapter structure 50 mounted therein. Thus, this aspect of the invention permits the small form factor cartridge 20 to be used in a carriage sized for a large form factor cartridge 90.

Figure 12:
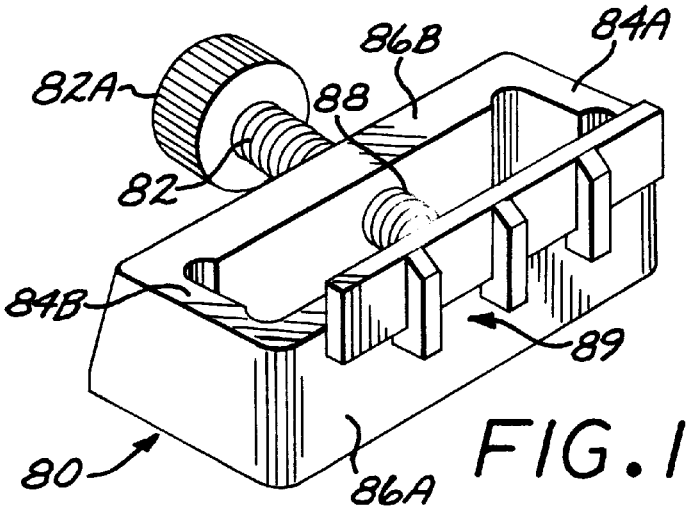
FIG. 12 is an isometric view of an alternative embodiment of an adapter structure employing a pressure connector to attach to the cartridge of FIG. 1.
Figure 13:
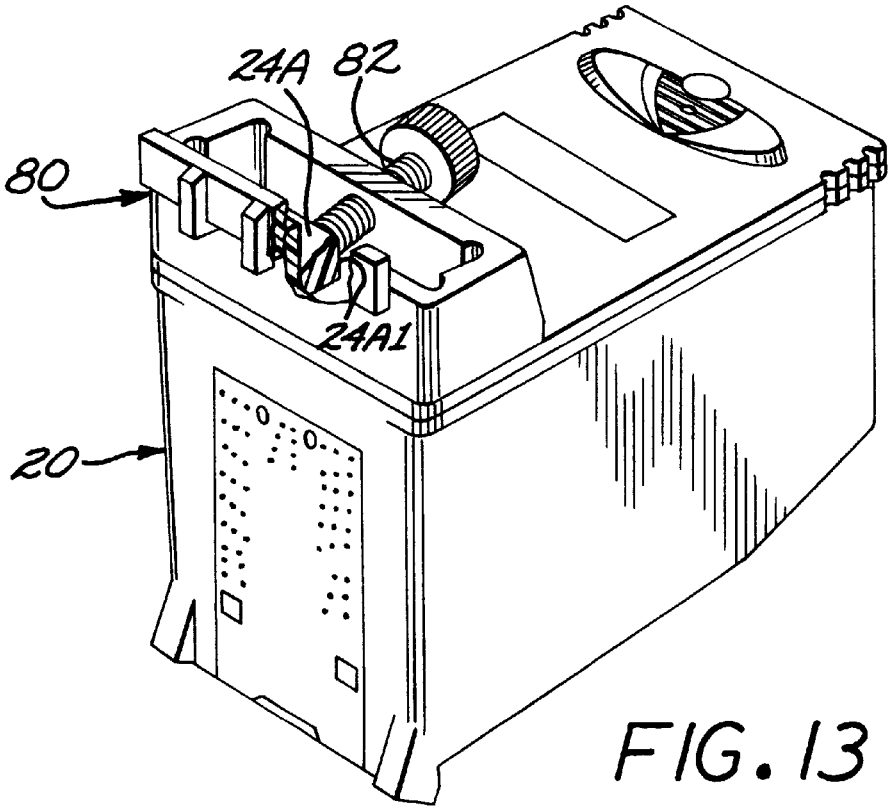
FIG. 13 is an isometric view of the assembly of the cartridge of FIG. 1 and the adapter structure of FIG. 12.

FIGS. 12 and 13 illustrate an alternate embodiment of an adapter structure 80 for adapting the small form factor cartridge 20 for use in a receptacle for a large form factor cartridge. This adapter structure 80 employs a pressure connector 82, in this exemplary embodiment a threaded pin 82, which is tightened against surface 24A1 of the latch feature 24A of the top cap of the cartridge. The structure 80 is an integral frame as in the structure 50, but smaller in size, to encircle the latch feature 24A when installed, as illustrated in FIG. 13. The structure includes side rail portions 84A, 84B and front and back rails 86A, 86B. The back rail has a threaded aperture 88 formed therein to receive the pin 82, which has a thumbscrew-type head 82A formed thereon to facilitate manual tightening of the fastener. The aperture is formed at an angle from the horizontal, and the back rail exterior surface has a beveled portion into which the pin 82 is threaded. When the frame is positioned on top of the cap 24 and about the latch feature, the adapter is locked in position by tightening the pin 82 against the back surface of the latch feature. The pin acts at an angle (sloped down towards the front of the pen) to ensure that the adapter is seated on the top cap of the cartridge. The front rail portion 86A includes a datum surface at 89 identical to that of the structure 50, which seats against a corresponding carriage datum surface when the cartridge-adapter assembly as shown in FIG. 13 is mounted in a carriage stall sized for a large form factor cartridge.

The short form factor inkjet cartridge can be constructed as a disposable cartridge, which is used until the internal supply or supplies of ink are exhausted, and then discarded or recycled. Alternatively the short form factor ink-jet cartridge can be a refillable cartridge, wherein the internal reservoir or reservoirs are refilled after the initial supply is exhausted. This refilling can be accomplished by different techniques. One technique is to insert a hollow needle into a refill port or opening formed in the top lid of the cartridge, and releasing ink into the internal reservoir through the needle. The needle is connected to a refill supply of ink in an ink container.

The short form factor ink-jet cartridge can be used by attaching an adapter to the short form factor ink jet cartridge to form a tall form factor cartridge assembly, and removably mounting the tall form factor cartridge assembly within a cartridge stall dimensioned to receive a tall form factor ink jet cartridge. The tall form factor cartridge assembly is removed from the cartridge stall when the short form factor cartridge has substantially exhausted the supply of ink. The adapter is removed from the short form factor ink jet cartridge, and attached to another short form factor ink jet cartridge having a fall supply of ink to form another tall form factor cartridge assembly. The new assembly is then removably mounted in the carriage stall.

Alternatively, instead of replacing the first short form factor ink-jet cartridge with another cartridge with a fresh supply of ink, the tall form factor cartridge assembly can be removed from the cartridge stall when the short form factor cartridge has substantially exhausted the supply of ink, the short form factor cartridge refilled with a new supply of ink, and then replaced in the cartridge stall. The cartridge can be refilled by removing the adapter from the short form factor cartridge to facilitate the refilling process; and mounting the adapter to the short form factor cartridge when the cartridge is recharged with a new supply of ink.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. An inkjet cartridge adapter kit comprising:

a small inkjet cartridge including a cartridge housing, a printhead mounted on the housing, a plurality of datum surfaces on said housing for registering a position of the cartridge housing in a fixed, repeatable position in a first carriage structure, and a cartridge set of electrical contacts mounted to the cartridge housing and electrically coupled to the printhead, said cartridge set of electrical contacts positioned on the housing for electrical contact with a corresponding first carriage set of electrical contacts when the cartridge is mounted in the first carriage structure; and a large adapter structure for attachment to the cartridge housing to provide an assembly of said adapter structure and said cartridge, said assembly adapted for mounting in a second carriage structure configured to receive an inkjet cartridge in a fixed, repeatable position, said second carriage structure having a second carriage set of electrical contacts for contacting by said cartridge set of electrical contacts when the cartridge is in said fixed, repeatable position in said second carriage structure.

2. The kit of claim 1, wherein said inkjet cartridge is a low profile cartridge having a low profile height dimension which is smaller than a corresponding height dimension of said inkjet cartridge of said large size.

3. The kit of claim 2, wherein the adapter structure is sized in combination with the low profile height dimension to provide an assembly height dimension matching said height dimension of said inkjet cartridge of said large size.

4. The kit of claim 1 wherein said housing has opposing top and bottom ends, said printhead affixed to the bottom end, and a face surface connecting the top and bottom ends, the cartridge set of contacts attached to the face surface.

5. The kit of claim 4 wherein said adapter structure fits onto said cartridge housing at said top end.

6. The kit of claim 1 wherein said adapter structure comprises a frame structure cooperatively sized with the cartridge housing for a snap fit onto said cartridge housing.

7. The kit of claim 1 wherein said adapter structure comprises a frame structure including a pressure fastener for attaching the frame structure to the cartridge housing.

8. An ink delivery system, comprising:

a short form factor ink jet cartridge having a supply of ink to facilitate the depositing of ink on an ink receiving medium; and an adapter mounted to said short form factor cartridge to permit it to be removably mounted within a cartridge stall dimensioned to receive a tall form factor cartridge.

9. An ink delivery system according to claim 8, wherein said adaptor is a snap on adapter which is mounted to the short form factor cartridge without the need for any tools.

10. An ink delivery system according to claim 8, wherein said short form factor ink jet cartridge is a refillable ink jet cartridge.

11. An ink delivery system according to claim 8, wherein said short form factor cartridge includes:

a housing having a chamber for containing said supply of ink and an ink outlet port in fluid communication with said chamber;

a print head mounted at said ink outlet port and having a plurality of ink ejection orifices communicating with said supply of ink through said ink outlet port; and an integrated plug lid secured to said housing for helping to seal said chamber to facilitate the fluid communication of the supply of ink through said ink outlet port.

12. An ink delivery system according to claim 11, wherein said integrated plug lid includes an upstanding boss for receiving thereon said adapter.

13. An ink delivery system according to claim 12, wherein said boss is generally rectangular in shape.

14. An ink delivery system according to claim 12, wherein said adapter is box-shaped having a front wall, a back wall, a pair of side walls, said front, back and side walls forming an open box configuration dimensioned to receive therein said boss;

a tapped aperture extending through said back wall; and a thumbscrew mounted threadably within said aperture for securing said adapter to said boss when the adapter is disposed on said boss.

15. A method for mounting a short form factor ink jet cartridge into a receptacle stall sized for a tall form factor ink jet cartridge, comprising:

providing the short form factor ink jet cartridge having a supply of ink for facilitating the depositing of ink on an ink receiving medium; and mounting an adapter to said short form factor cartridge to provide a cartridge-adapter assembly for removably mounting within the cartridge stall dimensioned to receive a tall form factor cartridge; and mounting the cartridge adapter assembly in the cartridge stall.

16. A method of using a short form factor ink jet cartridge having a supply of ink, comprising:

attaching an adapter to the short form factor ink jet cartridge to form a cartridge adapter assembly;

removably mounting said tall form factor cartridge assembly within a cartridge stall dimensioned to receive a tall form factor ink jet cartridge.

17. A method of using a short form factor ink jet cartridge according to claim 16, further comprising:

removing said cartridge adapter assembly from said cartridge stall when the short form factor cartridge has substantially exhausted the supply of ink;

removing said adapter from the short form factor ink jet cartridge;

attaching said adapter to another short form factor ink jet cartridge having a full supply of ink to form another cartridge adapter assembly; and removably mounting said another cartridge adapter assembly in said carriage stall.

18. A method of using a short form factor cartridge according to claim 16, further comprising:

removing said cartridge adapter assembly from said cartridge stall when the short form factor cartridge has substantially exhausted the supply of ink;

refilling the short form factor cartridge with a new supply of ink; and removably mounting said cartridge adapter assembly in said cartridge stall.

19. A method of using a short form factor ink jet cartridge according to claim 18 wherein said step of refilling includes:

removing said adapter from the short form factor cartridge to facilitate the refilling process; and mounting said adapter to the short form factor cartridge when the cartridge is recharged with a new supply of ink.

20. A method of using a short form factor ink jet cartridge according to claim 16 wherein said step of attaching an adapter includes mounting the adapter to a top lid structure of the short form factor ink jet cartridge, the adapter including a frame structure fitting onto the top lid about its periphery.

21. A method of using a short form factor ink jet cartridge according to claim 16 wherein said step of attaching an adapter includes attaching the adapter to a boss structure protruding from a top lid structure of the short form factor ink jet cartridge by a pressure connector.

* * * * *